US006575555B1

(12) United States Patent
Markowitz et al.

(10) Patent No.: US 6,575,555 B1
(45) Date of Patent: Jun. 10, 2003

(54) PRINTING APPARATUS AND SUBSTRATE FEEDING SYSTEM PARTICULARLY USEFUL THEREIN

(75) Inventors: Jakov Markowitz, Rehovot (IL); Grigori Rodin, Rishon Le-Zion (IL)

(73) Assignee: Nur Macroprinters Ltd., Lod (IL)

( * ) Notice: Subject to any disclaimer, the term of this patent is extended or adjusted under 35 U.S.C. 154(b) by 0 days.

(21) Appl. No.: 09/503,906

(22) Filed: Feb. 15, 2000

(30) Foreign Application Priority Data

Feb. 15, 1999 (IL) ..... 128540

(51) Int. Cl.[7] ..... B41J 2/165
(52) U.S. Cl. ..... 347/28; 347/104
(58) Field of Search ..... 347/104, 28, 85, 347/43; 346/136; 226/21

(56) References Cited

U.S. PATENT DOCUMENTS 3,995,399 A * 12/1976 Weiner et al. ..... 451/311
4,593,295 A * 6/1986 Matsufuji et al. ..... 347/43 X
4,803,500 A * 2/1989 Mllbrandt ..... 347/43 X
4,804,979 A * 2/1989 Kamas et al. ..... 347/116
5,287,123 A * 2/1994 Medin et al. ..... 347/102 X
5,751,303 A * 5/1998 Erickson et al. ..... 347/104 X
6,199,976 B1 * 3/2002 Sasada ..... 347/85
6,372,064 B1 * 4/2002 Butterworth et al. ..... 156/64

FOREIGN PATENT DOCUMENTS

EP 0 540 207 5/1993

* cited by examiner

*Primary Examiner*—Shih-Wen Hsieh
(74) *Attorney, Agent, or Firm*—Eitan, Pearl, Latzer & Cohen Zedek, LLP.

(57) ABSTRACT

A printing apparatus for printing on a substrate is provided. The apparatus includes a substrate feeding system for feeding the substrate through a printing station in the apparatus and a printing system at the printing station for printing on the substrate. The substrate feeding system includes a drive roll upstream of the printing station; a drive motor for driving the drive roll, a tension roll downstream of the printing station; a tension motor for driving the tension roll, a coupling assembly coupling the tension motor to the tension roll and effective to apply a pivotal force to the tension motor in one direction about the axis of the tension roll according to the actual tension on the substrate, and a biasing-force device effective to apply a pivotal biasing force to the tension motor in the opposite direction about the axis of the tension roll according to the desired tension on the substrate.

27 Claims, 6 Drawing Sheets

PRINTING APPARATUS AND SUBSTRATE FEEDING SYSTEM PARTICULARLY USEFUL THEREIN

CROSS REFERENCE

This application claims priority under 35 U.S.C. § 119 from Israeli patent application NO. 128540 filed on Feb. 15, 1999.

FIELD AND BACKGROUND OF THE INVENTION

The present invention relates to printing apparatus, and also to a substrate feeding system particularly useful in such apparatus. The invention is especially useful in high-speed ink-jet printing apparatus for printing large, multi-colored signs, and is therefore described below with respect to such an application.

One of the particularly difficult problems in high speed printing apparatus is the need to maintain the proper tension on the substrate as it is fed through the apparatus. The amount of tension to be applied to the substrate depends to a large extent on the nature of the substrate itself. If the tension is too low, the substrate may not feed properly through the apparatus, and/or the printing system may not properly print on the substrate in the printing station. On the other hand, if the tension is too high, the substrate may rupture, resulting in considerable wastage of materials and production time on the apparatus.

Another problem encountered particularly by ink-jet printing apparatus is the difficulty to maintain the ink-jet modules clean so as to minimize the possibility of blockage. Thus, when a jet-ink printer is turned-off, e.g., between printing runs, the ink within the ink supply system may dry, producing solid particles which can clog the fine orifices of the nozzles.

A further problem involved in high-speed printing by ink-jets is the need to print with relatively high resolution, and without smear, at relatively high printing rates. In conventional jet printers, high resolution may be obtained by decreasing the printing speed, but this substantially decreases the output of the apparatus. On the other hand, if the printing speed is increased In order to increase the output printing rate, this not only reduces the resolution, but also tends to produce smear in the printed marks because of the high differential velocity between the print heads and the substrate.

One object of the present invention is to provide a substrate feeding system particularly for printing apparatus, which system addresses the above-described substrate-tension problem in a novel and efficient manner. Another object of the present invention is to provide printing apparatus, particularly of the ink-jet type, which enables the nozzles to be cleaned when desired in an efficient manner in order to minimize the possibility of nozzle clogging by solid ink particles within the ink supply. A further object is to provide an inkjet printer which permits printing at high speed with high resolution and with no smear.

BRIEF SUMMARY OF THE PRESENT INVENTION

According to one aspect of the present invention, there is provided printing apparatus for printing on a substrate, comprising: a substrate feeding system for feeding the substrate through a printing station in the apparatus; and a printing system at the printing station for printing on the substrate; the substrate feeding system including; a drive roll upstream of the printing station; a drive motor for driving the drive roll; a tension roll downstream of the printing station; a tension motor for driving the tension roll; a coupling assembly coupling the tension motor to the tension roll and effective to apply a pivotal force to the tension motor in one direction about the axis of the tension roll according to the actual tension on the substrate; and a biasing-force device effective to apply a pivotal biassing force to the tension motor in the opposite direction about the axis of the tension roll according to the desired tension on the substrate.

According to further features in the preferred embodiment of the invention described below, the biassing-force device includes a piston displaceable within a cylinder, one of which is fixed and the other of which is coupled to the tension motor to apply the pivotal force in the opposite direction from that applied to the tension roll by the actual tension on the substrate. In the described preferred embodiment, the cylinder and piston define between them a fluid chamber having presettable means for presetting the fluid pressure therein, and thereby the desired tension on the substrate.

According to further features in the described preferred embodiment, the tension motor is coupled to the tension roll by a worm driven by the tension motor, meshing with a gear fixed to the tension roll. The gear is enclosed within a gear housing, and the tension motor is enclosed within a motor housing fixed to the gear housing, the motor housing being pivotal about the axis of the tension roll.

According to still further features in the described preferred embodiment, the drive motor drives the drive roll in steps, and the tension motor drives the tension roll in steps in synsyronism with the drive motor. The substrate feed system further includes a supply roll upstream of the drive roll, the supply roll including a restraining device for restraining tie rotation of the supply roll, and an encoder device for providing an indication of the amount of substrate paid out to the drive roll The drive motor drives the drive roll in the longitudinal direction of the substrates and tic printing system includes a printing head assembly which is driven in the transverse direction of the substrate during the intervals between the stepped movements of the substrate in the longitudinal direction. The printing head assembly includes at least one print head having a linear array ink nozzles arranged in the longitudinal direction of the substrate.

According to another aspect of the present invention, there is provided printing apparatus for printing on a substrate, comprising a substrate feeding system for feeding the substrate through a printing station in the apparatus, and a printing system at the printing station for printing on the substrate, which printing system comprises at least one print head having a linear array of ink-jet nozzles arranged in the longitudinal direction of the substrate. The printing system further includes: a common reservoir for all the nozzles in the print head; an ink supply; a solvent supply; a fluid pressure supply; a purging outlet; an ink pump for pumping ink from the ink supply to the common reservoir; a solvent pump for pumping solvent from the solvent supply to the common reservoir; and control devices for controlling the printing system to selectively connect: (a) the ink pump to the common reservoir to feed ink to the common reservoir; (b) the solvent pump to the common reservoir to feed solvent to the common reservoir; (c) the fluid pressure source and the ink supply to the common reservoir, when containing ink, to return the ink to the ink supply; and (d) the fluid pressure source and the purging outlet to the common reservoir, when containing solvent, to discharge the solvent through the purging outlet.

According to a further aspect of the present invention, there is provided printing apparatus for printing on a substrate, comprising: a substrate feeding system for feeding the substrate through a printing station in the longitudinal direction of the substrate; and a printing system at the printing station movable over the substrate in the transverse direction with respect to the substrate; the printing system comprising a printing head assembly which includes at least three pairs of print heads each provided with a linear array of nozzles for printing with the same color ink; the nozzles of each print head of each pair being staggered with respect to the nozzles of the other print head of the pair; the nozzles of each pair of print heads being staggered with respect to the nozzles of the other pairs of print heads.

According to a still further aspect of the present invention, there is provided a substrate feeding system for feeding a substrate, comprising: a drive roll and a drive motor for driving the drive roll; a tension roll and a tension motor for driving the tension roll; a coupling assembly coupling the tension motor to the tension roll and effective to apply a pivotal force to the tension motor in one direction about the axis of the tension roll according to the actual tension on the substrate; and a biassing-force device effective to apply a pivotal force to the tension motor in the opposite direction about the axis of the tension roll according to the desired tension on the substrate.

As will be described more particularly below, the foregoing features of the present invention address the tension-control problem, the printing-speed problem, and the nozzle-cleaning problem, in an efficient manner which is particularly useful in high-speed printers for printing large multi-colored signs.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

General Construction

The printing apparatus illustrated in the accompanying drawings is designed particularly as a high-speed, ink-jet printer for printing large multi-colored signs having a length in the order of one or more meters. Briefly, such apparatus comprises, a substrate feeding system for feeding a substrate, such as a web of paper or plastic, through a printing station in the apparatus; a printing system Including a multi-color printing head assembly at the printing station for printing on the substrate; and an ink supply and cleaning system for supplying ink to the print heads of the printing system, and also for cleaning the ink supply between printing runs lines to prevent clogging of the nozzles.

Figure 1:
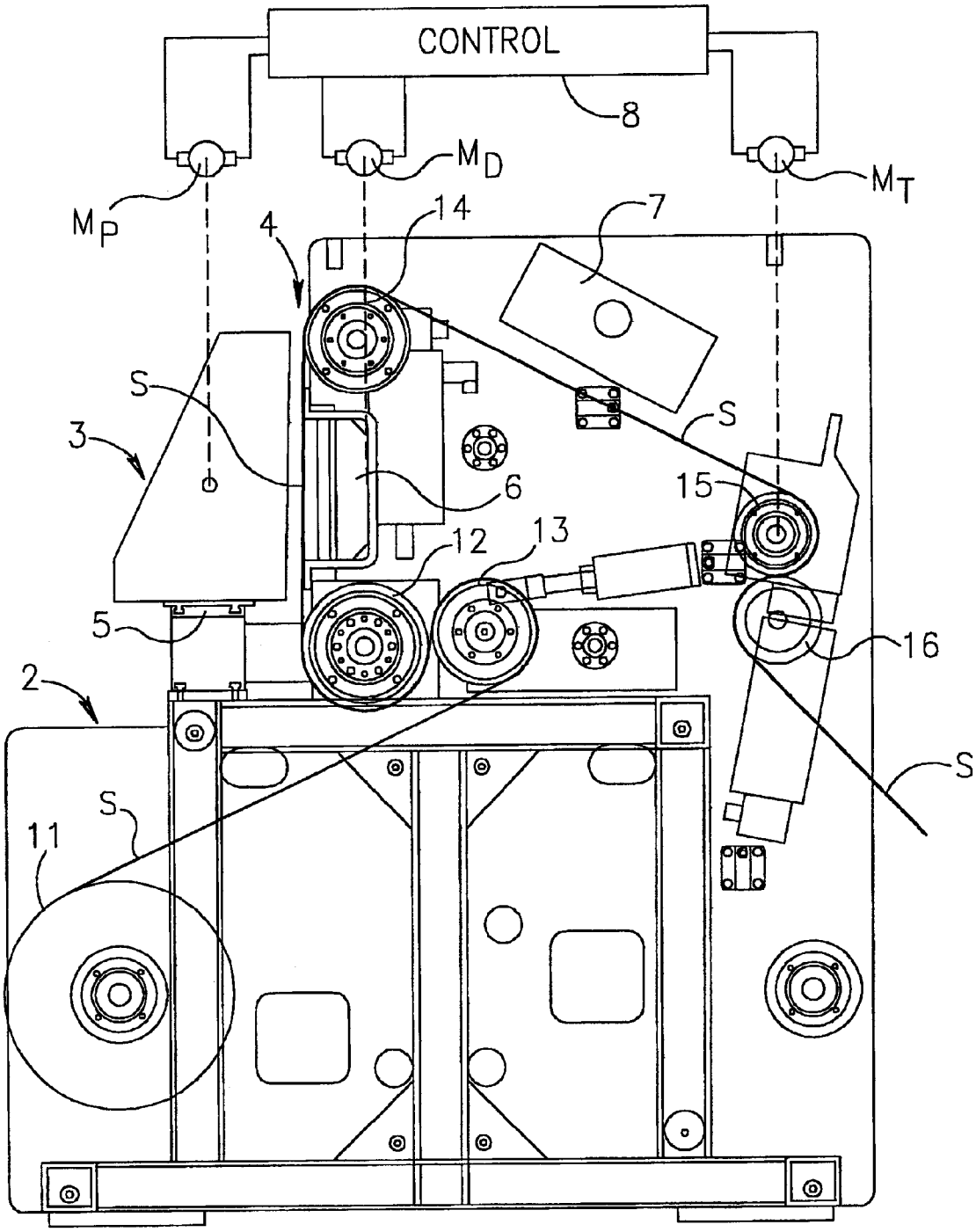
FIG. 1 is a side elevational view diagrammatically illustrating one form of printing apparatus constructed in accordance with the present invention.

As shown particularly in FIG. 1, the illustrated apparatus includes a main frame, generally designated 2, which supports the substrate feeding system and a printing head assembly, generally designated 3. The substrate feeding system feeds the substrates through a printing station for printing by a printing head assembly movable along a track 5. As will be described more particularly below, the substrate feeding system feeds the substrate S in stepped increments in the longitudinal direction of the substrate; and during the interval between each increment of stepped movement, the printing head assembly 3 is driven transversely of the substrate along track 5 to print a transverse swath thereon.

The printing station 4 includes a heated vacuum backing plate 6 formed with a plurality of openings connected to a vacuum source for firmly holding the substrate in position during the printing operation. The printed substrate is then passed through a dryer 7, for drying the ink before the printed substrate exits from the apparatus.

As will be described more particularly below, the illustrated apparatus includes a drive motor MD for step-feeding the substrate S; a tension motor MT for maintaining a pre-selected tension on the substrate; and a printing motor MP for driving the printing head assembly 4 transversely of the substrate during the printing operation. The foregoing motors as well as other electrical components of the apparatus, are all controlled by a control system generally designated 8 in FIG. 1.

Substrate Feeding System

Figure 2:
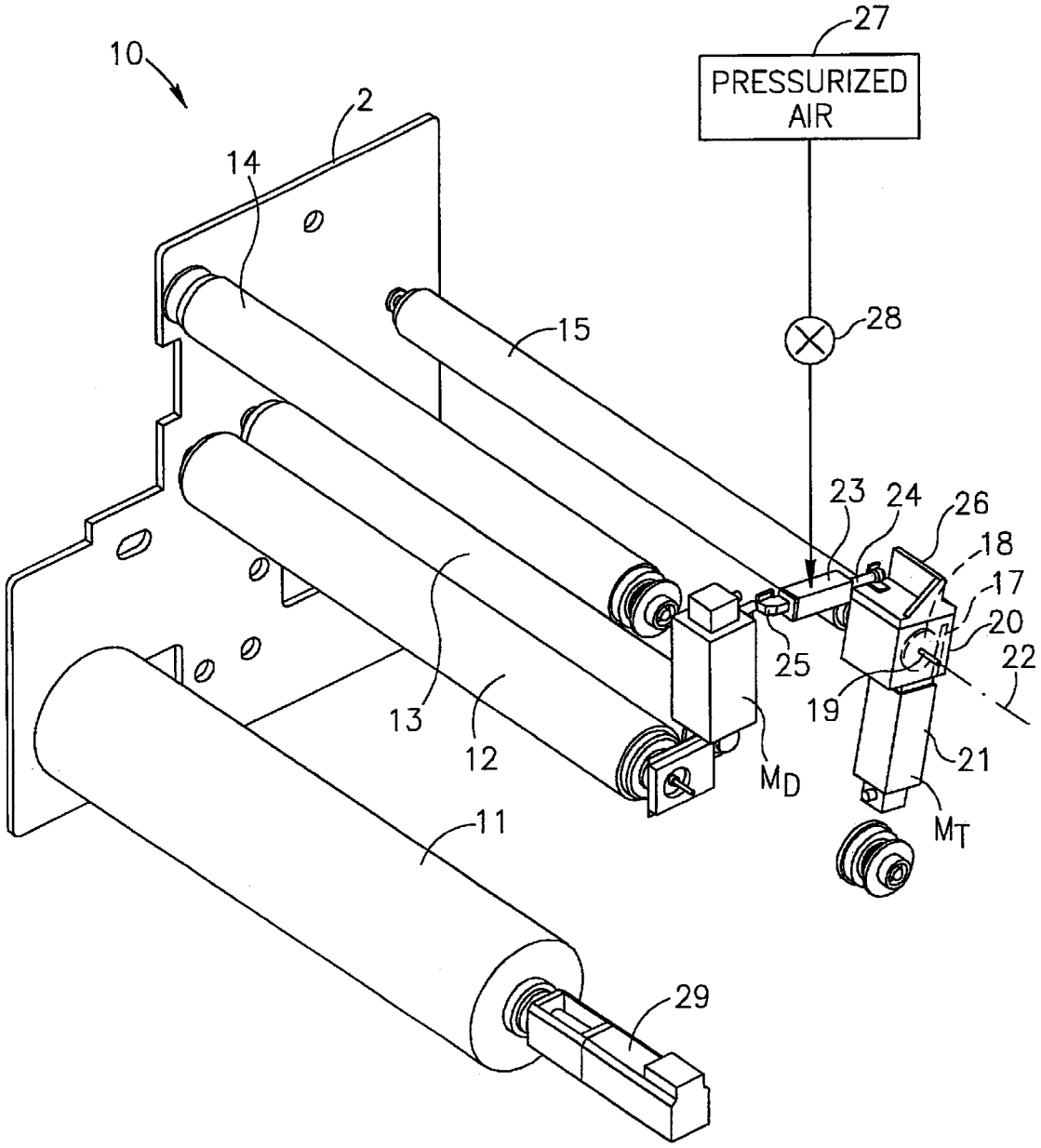
FIG. 2 is a three-dimensional view more particularly illustrating the substrate feeding system, and especially the tension control of the substrate in such a feeding system, in the printing apparatus of FIG. 1.

The substrate feeding system shown in FIG. 1 is more particularly illustrated in FIG. 2, where it is generally designated 10. Upstream of the printing station 4 (FIG. 1), the substrate feeding system includes a supply roll 11 for supplying the substrate S, a heated drive roll 12 driven by the drive motor MDin stepped increments, and a pinch roll 13 which, together with drive roll 12, advances the substrate S in steps through the printing station 4. Downstream of the printing station, the substrate feeding system includes a heated direction-changing roll 14 and a tension roll 15 driven by the tension motor MT which roll, together with its pinch roll 16 (FIG. 1), maintains a pre-selected tension on the substrates as it is advanced in stepped increments through the printing station.

The drive motor $M_D$ may be coupled in any suitable manner to the drive roll 12, to advance the substrate S in stepped increments under the control of the control system 8. Since such drives are well known in the jet-printer field, drive motor $M_D$ and its transmission coupling to the drive roll 12 are not illustrated in the drawings.

An important novel feature of the illustrated apparatus is the manner in which the tension motor $M_T$ cooperates with the tension roll 15 to maintain a predetermined tension the substrate S, and also to permit changing the predetermined tension according to the particular substrate used in the printing run. For example, some substrates require a tension of tens of kilograms for best results, whereas others may require a tension of hundreds of kilograms. The illustrated apparatus not only accurately maintains the proper tension on the substrate, but also enables the tension to be conveniently changed whenever necessary or desirable according to the substrate used in a particular printing run. Briefly, this is obtained by providing: (1) a coupling assembly coupling the tension motor $M_T$ to the tension roll 15 which is effective to apply a pivotal force to the tension motor in one direction about the axis of the tension roll according to actual tension on the substrate S; and (2) a biassing-force device effective to apply a presettable pivotal biassing force to the tension motor $M_T$ in the opposite direction about the axis of the tension roll 15 according to the desired tension on the substrate S.

As shown particularly in FIG. 2, the coupling assembly coupling the tension motor $M_T$ to the tension roll 15 includes a worm 17 rotated by the tension motor $M_T$ and meshing with a gear 18 fixed to the shaft 19 of the tension roll 15. Gear 18 is enclosed within a gear housing 20, and the tension motor $M_T$ is enclosed within a motor housing 21 fixed to the gear housing 20 so that both housings 20, 21 pivot together about the rotary axis 22 of the tension roll 15 and its shaft 19.

This pivotal movement of the gear housing 20 and motor housing 21 about axis 22 is resisted by a biassing-force device including a cylinder 23 and a piston 24 movable within the cylinder. The cylinder 23 is secured to a fixed element 25 of the printing apparatus frame 2; and the piston 24 is secured to a flange 26 on the gear housing 20.

Piston 24 defines, with cylinder 23, a chamber within the cylinder containing a pressurized fluid, e.g., pressurized air, which applies a force against piston tending to move it outwardly of the cylinder. The pressure within the chamber in cylinder 23 is produced by a pressurized air supply 27, and is presetable by a presetable valve 28 between the air supply 27 and the chamber within cylinder 23.

The illustrated substrate feeding system operates as follows:

When the substrate is to be driven one stepped increment, the appropriate command is outputted by control 8 to the drive motor $M_D$ to rotate the drive roll 12 one stepped increment. Control 8 simultaneously outputs the same command to tension motor $M_T$ which, via its worm 17 meshing with gear 18 carried by tension roll 15, increments the tension roll 15 one step in synchronism with the incrementing of the drive roll 12.

It will also be seen that this pivotal movement of gear housing 20 applies a force tending to move piston 24 inwardly of cylinder 23. This movement of the piston is resisted by the fluid pressure within cylinder 23, which fluid pressure applies a force acting on piston 24 to move it outwardly of tile cylinder, in opposition to the force applied by the substrate acting to move the piston inwardly of the cylinder. The fluid pressure within cylinder 23 thus determines the pivotal position of motor housing 21, gear housing 20, and tension roll 15, and thereby the tension applied by the substrate S to the tension roll 15. That is, if the actual tension on the substrate is below tile value determined by the fluid pressure within cylinder 23, piston 24 will be moved by this pressure to rotate the gear housing 20, together with the motor housing 21 in the clockwise direction, which, via worn) 17 and gear 18, also rotates the tension roll 15 in the clockwise direction to increase the tension on the substrate S; on the other hand, if the actual tension on the substrate S is above the value determined by the fluid pressure within cylinder 23, piston 24 will pivot gear housing 20 and motor housing 21 in the opposite direction to thereby rotate the tension roll 15 in the counter-clockwise direction to decrease the tension on the substrate.

It will also be appreciated that since the actual tension maintained on the substrate is determined by the pressure of the fluid within the cylinder 23, the tension on the substrate may be conveniently changed, via the presetable pressure valve 28, to preselect the desired tension according to the substrate used in a particular printing run.

As shown particularly in FIG. 2, the supply roll 11 includes a restraining device, generally designated 29, for restraining the rotation of the supply roll such as to prevent slack in the section of the substrate S between the supply roll and the drive roll 12. Preferably, the restraining device 29 also includes an encoder for providing an indication of the amount of substrate paid out to the drive roll 12, to thereby advise the operator of the status of the substrate in the printing apparatus and to alert the operator of a need to provide a fresh supply roll of substrate.

Printing System

Figure 3:
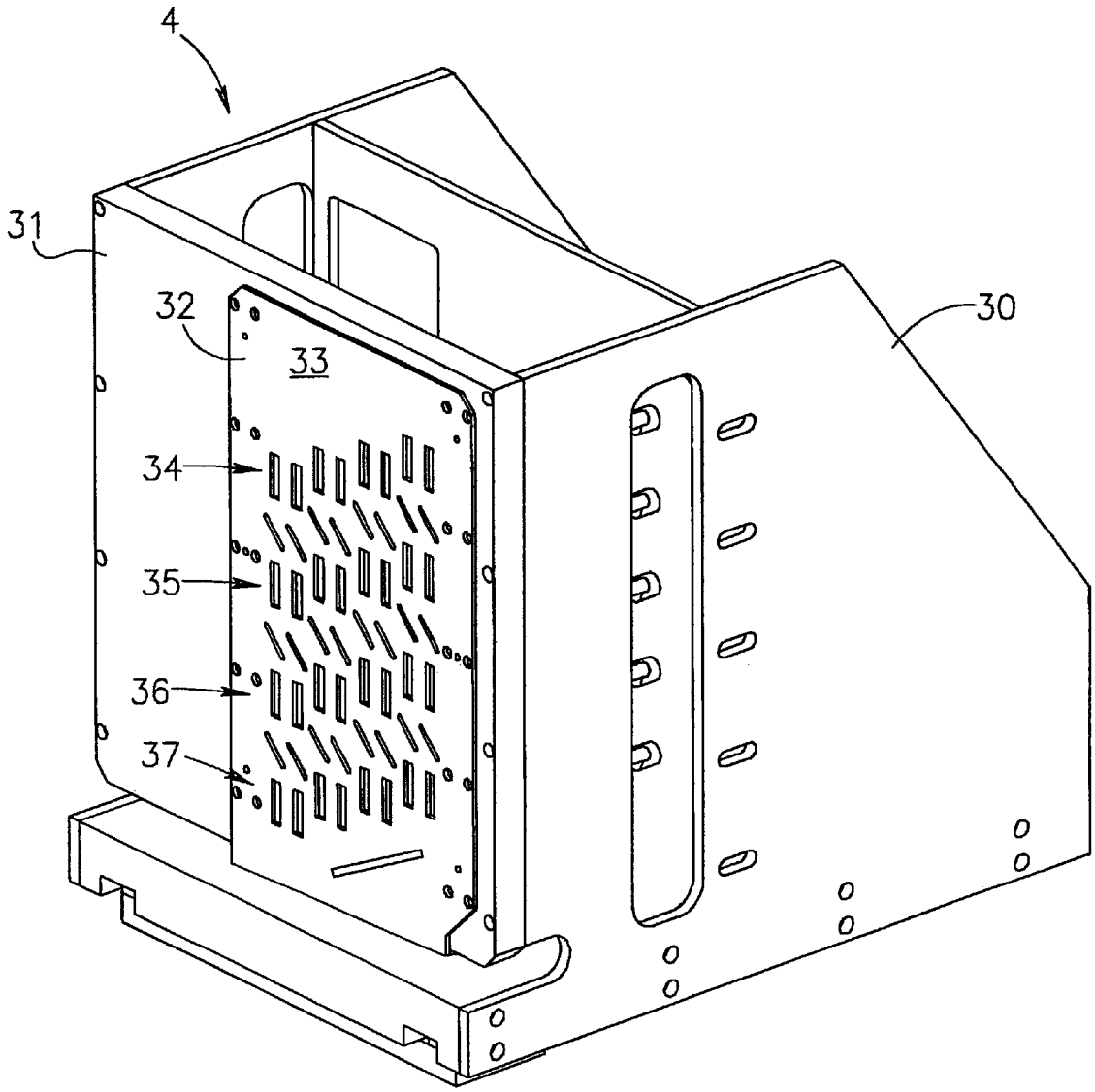
FIG. 3 is a three-dimensional view illustrating the printing head assembly in the printing apparatus of FIG. 1.
Figure 4:
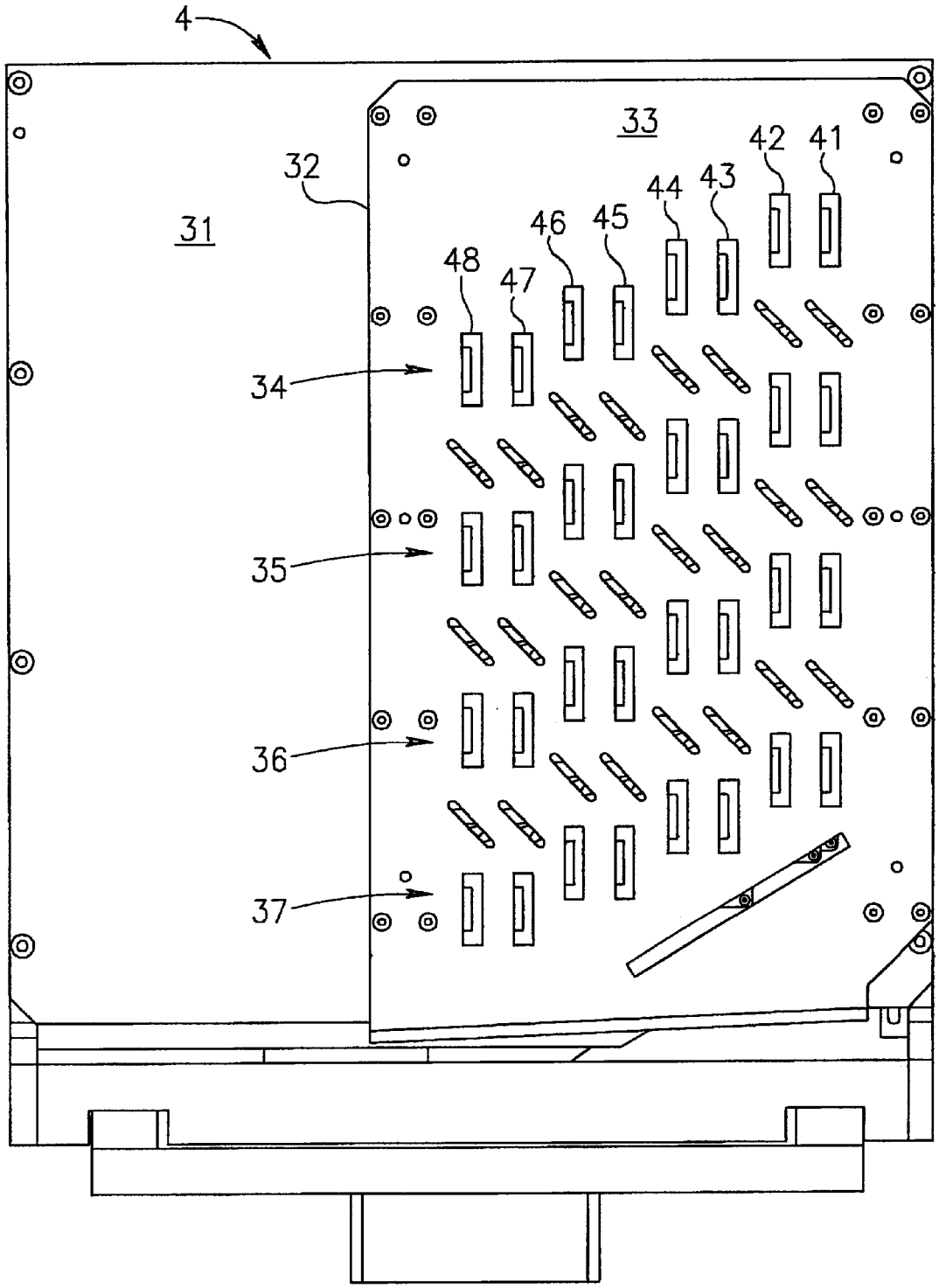
FIG. 4 is a rear view of the printing head assembly of FIG. 3, particularly illustrating the plurality of print heads carried by the assembly.
Figure 5:
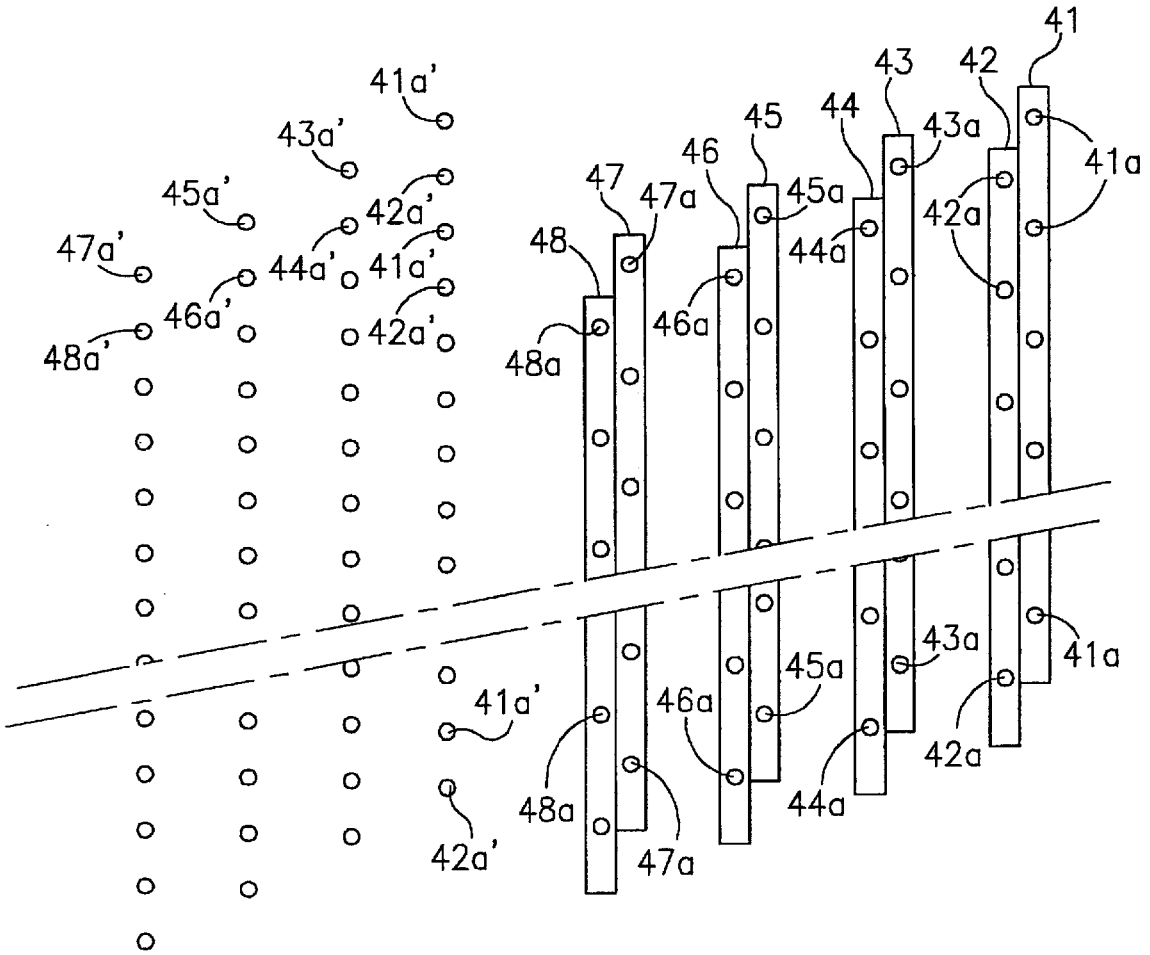
FIG. 5 diagrammatically illustrates the arrangement of print heads, their respective ink-jet nozzles, and the pattern of ink markings produced thereby on the substrate, in the printing head assembly of FIGS. 3 and 4.

FIGS. 3 and 4 more particularly illustrate the printing head assembly 3 in FIG. 1 in the printing station 4 which, as briefly described above, is driven by printing motor MP transversely across the substrate S for printing thereon during the intervals between the stepped movements of the substrate by the substrate feeding system. The illustrated apparatus prints in multiple colors, and therefore the printing head assembly 3 includes a separate array of print heads for each color. FIG. 5 more particularly illustrates tile array of print heads for one color, and the pattern of marks printed by this array of print heads on the substrate S.

Thus, as shown in FIG. 3, the printing head assembly 3 includes a housing 30 movable on track 5 at the front of the apparatus transversely across the printing station 4 for printing on the substrate within that station. The rear face 31 of housing 30, facing the backing plate 6, carries a plate 32 formed with an array of rectangular openings 33 for receiving the ink-jet print heads. Thus, openings 33 include a horizontal row of opening 34 for receiving the black ink print heads, an underlying horizontal row of opening 35 for receiving the magenta ink print heads, another row of opening 36 for receiving the cyan ink print heads, and a bottom of row 37 of openings for receiving the yellow ink print heads.

Each row of print heads includes four pairs of print heads in a staggered relationship. FIG. 5 more particularly illustrates the upper row 34 of print heads in the assembly of FIG. 4 for printing with black ink. This row includes the four print head pairs 41, 42; 43, 44; 45, 46; and 47, 48, all in a staggered relationship with respect to each other.

As also shown in FIG. 5, the nozzles in each print head are also in a staggered relationship with respect to the print head of its respective pair, as well as with respect to the print heads of the remaining pairs. Thus, as shown in FIG. 5, nozzles 41*a* of print head 41 are staggered with respect to nozzles 42*a* of print head 42; and so one with respect to the remaining print head pairs 43–48.

FIG. 5 further illustrates the pattern of marks printed on the substrate by the print heads 41–48. As shown in FIG. 5, each of pair of print heads is controlled such that the marks produced by their respective nozzles appear alternatingly in the same line on the substrate. Thus, as shown in FIG. 5, the marks produced by nozzles 41*a* of print head 41 are shown as 41*a*'; and the marks produced by nozzles 42*a* of print head 42, shown as 42*a*', appear alternatingly in the same line as the marks 41*a*'.

The four pairs of print heads 41–48 are controlled such that the four lines of marks are produced by the four pairs of prints in an interlaced and staggered manner. Thus, as further shown in FIG. 5, the marks produced by the nozzles 43*a* of print head 43, appearing as 43*a*', are in the same line as the marks 44*a*' produced by the nozzles 44*a* in print head 44 which line is between the line of marks produced by print head pair 41, 42 and print head pair 45, 46. As further shown in FIG. 5 the marks 43*a*', 44*a*' produced by print head pair 43, 44 are also staggered with respect to the marks 41*a*', 42*a*' and 45*a*', 46*a*', produced by the neighboring print head pairs 41, 42, and 45, 46.

Such an arrangement of print heads and nozzles permits printing at relatively high speeds, with relatively high resolution, and with a low tendency of smear by the movement of the printing head assembly with respect to the substrate at the time of printing.

Ink Supply and Cleaning System

Housing 30 of the printing head assembly 3 includes an ink reservoir for each pair of print heads. Thus, there would be four such reservoirs for the upper row of heads printing in black ink; and four additional reservoirs for each of the three additional rows of heads printing in magenta, cyan and yellow inks, respectively, or a total of 16 reservoirs.

Figure 6:
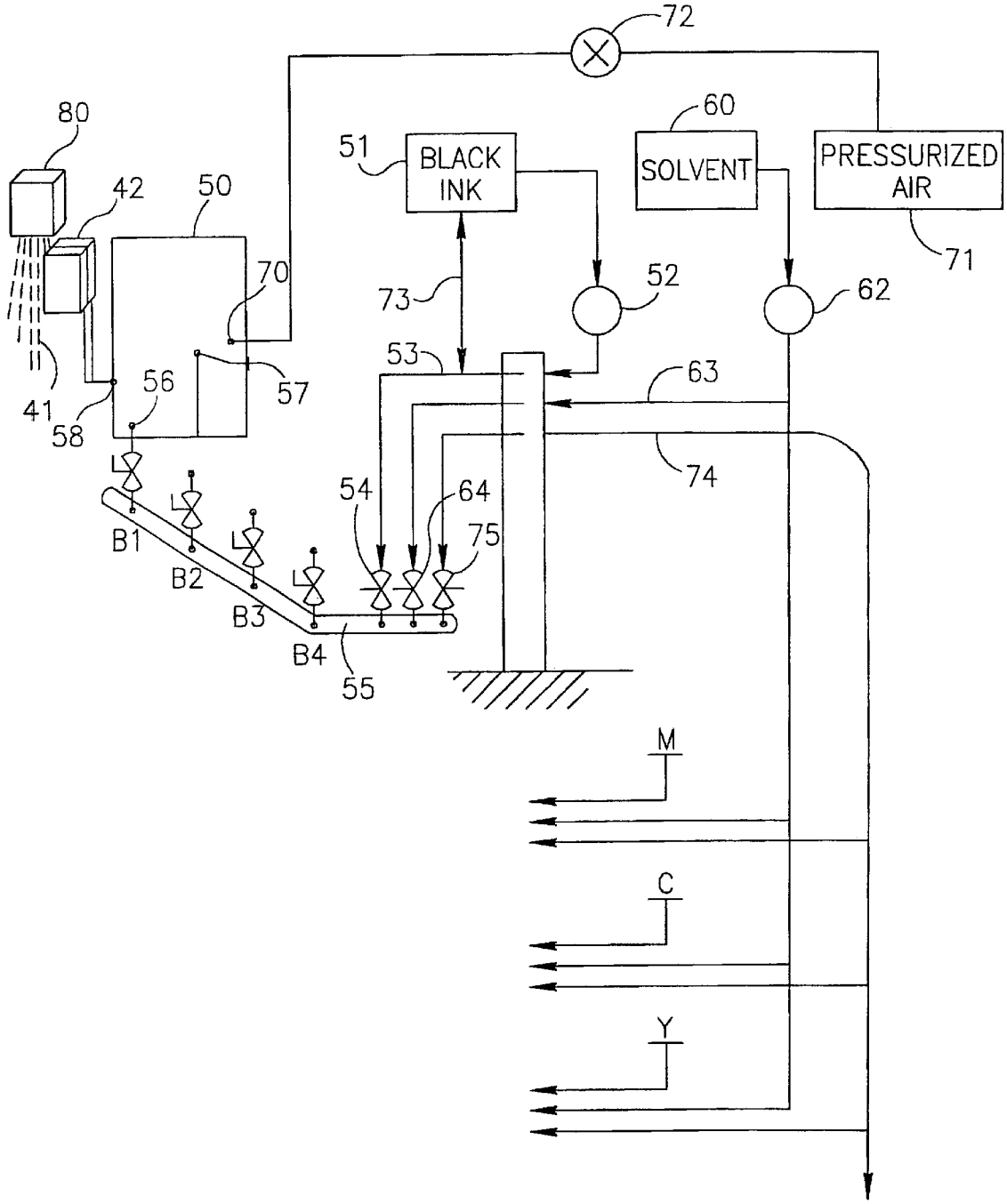
FIG. 6 diagrammatically illustrates the ink-supply and the ink-cleaning system for one pair of print heads in the printing head assembly of FIGS. 3–5.

FIG. 6 illustrates one reservoir, generally designated 50, for the pair of print heads 41, 42. This reservoir is supplied with black ink from a black ink supply 51 via a pump 52, line 53, valve 54, line 55 and inlet port 56.

Reservoir 50 includes an ink level sensor 57 for sensing the level of ink within the reservoir for controlling the pump 52 to maintain a predetermined level. The print heads 41, 42 are connected to the reservoir 50 via an inlet connection 58 which is always below the level of the ink within the reservoir to assure that the ink supplied to the print head is free of air bubbles.

FIG. 6 also illustrates a cleaning system for cleaning the ink supply system between printing runs, to prevent dried ink particles from clogging the nozzles of the print heads. This cleaning system includes a solvent supply 60 for feeding solvent to the ink reservoirs 50 of all the print heads in the printing head assembly 3 via pump 62, solvent supply line 63, valve 64, and line 55 of all the reservoirs 50.

Ink is relatively expensive, and therefore the inks remaining in their respective reservoirs 50 after a printing run are returned to their respective ink supply (e.g., 51) for re-use. On the other hand, the solvent is relatively inexpensive, and therefore this solvent, after cleaning the respective reservoirs 50 and the ink supply lines to those reservoirs, is merely disposed of and not re-used.

For the above purposes, all the ink reservoirs (e.g., as shown by ink reservoir 50 in FIG. 6) are in the form of closed containers and include a pressurized-air inlet port 70 connected to a source of air pressure 71 via a control valve 72. Thus, when a printing run is completed and it is desired to return the inks within their respective reservoirs 50 to their respective ink supplies (e.g. 51), valve 72 is opened to introduce pressurized air into the reservoir 50, and thereby to force the ink therein to flow from the reservoir back into its respective ink supply 51 via its respective valve 54 and ink recovery line 73. After the ink has thus been removed from its respective reservoir, valve 72 is closed, and solvent from the solvent supply 61 is fed, via pump 62, line 63 and valve 64, into line 55, and the reservoirs 50 for cleaning line 55 and the reservoirs. Valve 72 is then again opened to introduce pressurized air from source 71 into the reservoir 50, via its pressurized air inlet 70, and valve 75 is opened to force the solvent through line 55 and out through a purging line 74, for disposal or for reprocessing, as may be desired.

As shown in FIG. 6, there is a separate ink supply 51 for each pair of print heads, such that there would be four reservoirs 50 for the four pairs of print heads 41–48 in the upper line 34 of black-ink print heads; and four additional reservoirs for each pair of print heads for each of the three remaining ink colors. All of the ink reservoirs, (totaling 16 in number) would be located within the printing head assembly 3 adjacent to the respective line of print heads, i.e., just forwardly of plate 32 in FIG. 3. Each ink color supply 51 would thus be connected to the four print head for the respective color via its respective supply line 55. The solvent supply 60, however, is common for all the print heads for all the colors.

It will thus be seen that the described Ink supply and printing system permits unused ink within the respective reservoirs 50 to be returned to their respective ink supplies (e.g., 51) at the end of each printing run, thereby minimizing wastage of ink. In addition, the described system permits the ink reservoirs, and also the lines connecting them to their respective Ink supplies to be cleaned with the solvent after each printing run, thereby decreasing the possibility of clogging the print head nozzles by dried particles of ink.

The nozzles themselves may be cleaned by a spray device. Such a device is diagrammatically shown at 80 in FIG. 6 and would be controlled to spray solvent over the faces of the nozzles facing the substrate to clean them of ink particles between printing runs.

While the invention has been described with respect to one preferred embodiment, it will be appreciated that this is set forth merely for purposes of example, and that many other variations, modifications and applications of the invention may be made.

What is claimed is:

1. Printing apparatus for printing on a substrate, comprising:

a substrate feeding system for feeding the substrate through a printing station in the apparatus; and a printing system at said printing station for printing on the substrate;

said substrate feeding system including:

a drive roll upstream of said printing station;

a drive motor for driving said drive roll;

a tension roll downstream of said printing station;

a tension motor for driving said tension roll;

a coupling assembly coupling said tension motor to said tension roll and effective to apply a pivotal force to the tension motor in a first direction about an axis of the tension roll according to an actual tension on said substrate; and a constantly controllable biasing-force device effective to apply a pivotal self-adjusting biasing force to the tension motor in a direction opposite to the first direction about the axis of the tension roll according to an desired tension on said substrate.

2. The apparatus according to claim 1, wherein said biasing-force device is presettable to thereby enable presetting the desired tension on said substrate according to the particular substrate.

3. The apparatus according to claim 1, wherein said biasing-force device includes a piston displaceable within a cylinder, one of which is fixed and the other of which is coupled to the tension motor to apply said pivotal force in said opposite direction.

4. The apparatus according to claim 3, wherein said cylinder and piston define between them a chamber having controllable means for controlling the pressure therein, and thereby the desired tension on said substrate.

5. The apparatus according to claim 1, wherein said tension motor is coupled to said tension roll by a worm driven by the tension motor meshing with a gear fixed to said tension roll.

6. The apparatus according to claim 1, wherein said drive motor drives said drive roll in steps, and said tension motor drives said tension roll in steps in synchronism with said drive motor.

7. The apparatus according to claim 1, wherein said substrate feed system further includes a supply roll upstream of said drive roll, said supply roll including a restraining device for restraining the rotation of said supply roll and an encoder device for providing an indication of the amount of substrate paid out to the drive roll.

8. The apparatus according to claim 1, wherein said drive motor drives the drive roll in the longitudinal direction of said substrate, and said printing system includes a printing head assembly which is driven in the transverse direction of said substrate during the intervals between the stepped movements of the substrate In the longitudinal direction.

9. The apparatus according to claim 8, wherein said printing head assembly includes at least one print head having a linear array of ink-jet nozzles arranged in the longitudinal direction of the substrate.

10. The apparatus according to claim 9, wherein said printing system further includes:

a common reservoir for all the nozzles in said print head;

an ink supply;

a solvent supply;

a pressure supply;

a purging outlet;

an ink pump for pumping ink from said ink supply to said common reservoir;

a solvent pump for pumping solvent from said solvent supply to said common reservoir; and control devices for controlling said printing system to selectively connect:

(a) said ink pump to said common reservoir to feed ink to the common reservoir;

(b) said solvent pump to said common reservoir to feed solvent to the common reservoir;

(c) said pressure source and said ink supply to said common reservoir, when containing ink, to return the ink to the ink supply; and (d) said pressure source and said purging outlet to said common reservoir, when containing solvent, to discharge the solvent through the purging outlet.

11. The apparatus according to claim 10, wherein said printing head assembly includes at least a pair of said print heads having nozzles supplied by ink from said common reservoir.

12. The printing apparatus according to claim 11, wherein:

said printing head assembly includes at least three pairs of print heads for printing with the same color ink;

the nozzles of each print head of each pair are staggered with respect to the nozzles of the other print head of the pair, and the nozzles of each pair of print heads are staggered with respect to the nozzles of the other pairs of print heads.

13. The apparatus according to claim 10, wherein said printing system has a separate printing head assembly for each of a plurality of colors, at least one common reservoir for each color, and a common solvent supply for all the colors.

14. Printing apparatus for printing on a substrate, comprising:

a substrate feeding system for feeding the substrate through a printing station in the apparatus; and a printing system at the printing station for printing on the substrate; said printing system comprising:

at least one print head having a linear array of ink-jet nozzles arranged in the longitudinal direction of the substrate;

a common reservoir for all the nozzles in said print head;

an ink supply;

a solvent supply;

a pressure supply;

a purging outlet;

an ink pump for pumping ink from said ink supply to said common reservoir;

a solvent pump for pumping solvent from said solvent supply to said common reservoir; and control devices for controlling said printing system to selectively connect:

(a) said ink pump to said common reservoir to feed ink to the common reservoir;

(b) said solvent pump to said common reservoir to feed solvent to the common reservoir;

(c) said pressure source and said ink supply to said common reservoir, when containing ink, to return the ink to the ink supply; and (d) said pressure source and said purging outlet to said common reservoir, when containing solvent, to discharge the solvent through the purging outlet.

15. The apparatus according to claim 14, wherein said printing head assembly includes at least a pair of said print heads having nozzles supplied by ink from said common reservoir.

16. The printing apparatus according to claim 15, wherein:

said printing head assembly includes at least three pairs of print heads for printing with the same color ink;

the nozzles of each print head of each pair are staggered with respect to the nozzles of the other print head of the pair; and the nozzles of each pair of print heads being staggered with respect to the nozzles of the other pairs of print heads.

17. The apparatus according to claim 14, wherein said printing system has a separate printing head assembly for each of its plurality of colors, a common reservoir for each color, and a common solvent supply for all the colors.

18. Printing apparatus for printing on a substrate comprising:

a substrate feeding system for feeding the substrate through a printing station in the longitudinal direction of the substrate; and a printing system at said printing station movable over the substrate in the transverse direction with respect to the substrate;

said printing system comprising a printing head assembly which includes at least three pairs of print heads each provided with a linear array of nozzles for printing with tile same color ink;

the nozzles of each print head of each pair being staggered with respect to the nozzles of the other print head of the pair;

the nozzles of each pair of print heads being staggered with respect lo the nozzles of the other pairs of print heads;

wherein said printing system further includes:

a common reservoir for all the nozzles in sad printing head;

an ink supply;

a solvent supply;

a pressure supply;

a purging outlet;

an ink pump for pumping ink from said ink supply to said common reservoir;

a solvent pump for pumping solvent from said solvent supply to said common reservoir; and control devices for controlling said printing system to selectively connect:

(a) said ink pump to said common reservoir to feed ink to the common reservoir;

(b) said solvent pump to said common reservoir to feed solvent to the common reservoir;

(c) said pressure source and said ink supply to said common reservoir, when containing ink, to return the ink to the ink supply; and (d) said pressure source and said purging outlet to said common reservoir, when containing solvent, to discharge the solvent through the purging outlet.

19. The apparatus according to claim 18, wherein said printing head assembly includes at least a pair of said print heads having nozzles supplied by ink from said common reservoir.

20. The apparatus according to claim 18, wherein said printing system has a separate printing head assembly for each of a plurality of colors, at least one common reservoir for each color, and a common solvent supply for all the colors.

21. A substrate feeding system for feeding a substrate, comprising:

a drive roll and a drive motor for driving said drive roll;

a tension roll and a tension motor for driving said tension roll;

a coupling assembly coupling said tension motor to said tension roll aid effective to apply a pivotal force to the tension motor in a first direction about an axis of the tension roll according to an actual tension on said substrate; and a constantly controllable biasing-force device effective to apply a pivotal self-adjusting force to the tension motor in the direction opposite to the first direction about the axis of the tension roll according to an desired tension on said substrate.

22. The apparatus according to claim 21, wherein said biasing-force device is presettable to thereby enable presetting the desired tension on said substrate according to the particular substrate.

23. The apparatus according to claim 21, wherein said biasing-force device includes a piston displaceable within a cylinder, one of which is fixed and the other of which is coupled to the tension motor to apply said pivotal force in said opposite direction.

24. The apparatus according to claim 23, wherein said cylinder and piston define between them a chamber having controllable means for controlling the pressure therein, and thereby the desired tension on said substrate.

25. The apparatus according to claim 21, wherein said tension motor is coupled to said tension roll by a worm driven by the tension motor meshing with a gear fixed to said tension roll.

26. The apparatus according to claim 21, wherein said drive motor drives said drive roll In steps, and said tension motor drives said tension roll in steps in synchronism with said drive motor.

27. The apparatus according to claim 21, wherein said substrate feed system further includes a supply roll upstream of said drive roll, said supply roll including a restraining device for restraining the rotation of said supply roll, and an encoder device for providing an indication of the amount of substrate paid out to the drive roll.

* * * * *